US005852402A

United States Patent [19]

Perry

[11] Patent Number: 5,852,402

[45] Date of Patent: Dec. 22, 1998

[54] INTRUSION DETECTION SYSTEM

[75] Inventor: Haim Perry, Hackensack, N.J.

[73] Assignee: Safeguards technology, inc., Hackensen, N.J.

[21] Appl. No.: 72,653

[22] Filed: May 5, 1998

Related U.S. Application Data

[60] Provisional application No. 60/063,552 Oct. 28, 1997.

[51] Int. Cl. [6] ..... G08B 13/00

[52] U.S. Cl. ..... 340/541; 340/644; 340/668; 256/2; 256/10

[58] Field of Search ..... 340/541, 550, 340/555, 664, 666, 668, 564, 565, 548; 256/2, 7, 10; 200/61.93

[56] References Cited

U.S. PATENT DOCUMENTS

| | | | |
|---|---|---|---|
| 4,155,083 | 5/1979 | Slaats et al. | 340/666 |
| 4,367,459 | 1/1983 | Amir et al. | 340/541 |
| 4,533,906 | 8/1985 | Amir | 340/541 |
| 4,643,400 | 2/1987 | Porat | 256/52 |
| 4,680,573 | 7/1987 | Ciordinik et al. | 340/541 |
| 4,683,356 | 7/1987 | Stoler | 200/61.93 |
| 4,730,809 | 3/1988 | Stoler | 256/1 |
| 4,803,468 | 2/1989 | Seifert | 340/566 |
| 4,829,286 | 5/1989 | Zvi | 340/541 |
| 4,829,287 | 5/1989 | Kerr et al. | 340/541 |
| 4,929,926 | 5/1990 | Porat | 340/541 |
| 5,103,207 | 4/1992 | Kerr et al. | 340/541 |
| 5,371,488 | 12/1994 | Couch et al. | 340/541 |
| 5,438,316 | 8/1995 | Motsinger et al. | 340/541 |

*Primary Examiner*—Jeffery A. Hofsass
*Assistant Examiner*—Van T. Trieo
*Attorney, Agent, or Firm*—Knobbe, Martens, Olson & Bear LLP

[57] ABSTRACT

A taut wire fence system comprises wire-supporting anchor posts that maintain the taut wires of the system in tension. Sensor posts having tension sensors mounted therein are positioned between pairs of anchor posts to monitor changes in tension caused by intrusion attempts. To protect against attempts to bypass the tension sensors (such as by cutting the taut wires while using a frame device to maintain wire tension), one or more tensioned cable segments are provided in tension between the anchor posts (preferably along the lower portion of the fence) to form an electrical path. An electrical monitoring device is then used to monitor the continuity of the electrical path. The tensioned cable segments are preferably formed from a special cable that includes an outer layer which forms a physical barrier to cutting. Preferably, the electrical path includes two or more segments of cable that are electrically interconnected by a resistive member, and the monitoring device operates by effectively monitoring the resistance of the path. The cable segments may be provided in place of the lower-most taut wires of a conventional taut wire fence system, or may be provided in between existing taut wires to provide an alternating arrangement of taut wires and cable segments. Also disclosed is a taut wire sensor extender assembly that can be used to add cable segments and/or ordinary taut wires to an existing fence system without the need for additional tension sensors. The sensor extender assembly attaches to an existing tension sensor that is designed to monitor a fixed number (e.g., 2) of taut wires, and allows the sensor to monitor a greater number of tensioned wires.

14 Claims, 9 Drawing Sheets

INTRUSION DETECTION SYSTEM

RELATED APPLICATION

This application claims the benefit of U.S. provisional application Ser. No. 60/063,552, filed Oct. 28, 1997, titled INTRUSION DETECTION SYSTEM.

FIELD OF THE INVENTION

This invention relates to intrusion detection systems of the type which use taut wires to form a physical barrier, and which use tension sensors coupled to the taut wires to detect attempts to defeat the physical barrier.

BACKGROUND OF THE INVENTION

A variety of intrusion detection systems are known, ranging from those protecting private residences to those protecting large-scale, relatively high security, facilities such as airports and military installations. A number of the systems of the second kind, those protecting large-scale facilities, typically provide a combination of a physical barrier and an electronic detection capability. A taut wire intrusion detection system provides such a combination. Such a system is available, for example, from Safeguards Technology of Hackensack, N.J. The present invention provides a solution to a weakness in existing taut wire intrusion detection systems.

A typical taut wire intrusion detection system will include sensors, sensor posts, taut wires, anchor posts, and slider posts. A single or several sensors will usually be mounted on a post, typically referred to as the "sensor post". Taut wires, commonly formed from a double strand steel barbed wire, are attached to the single sensor or group of sensors mounted on the sensor post. Each taut wire segment ("taut wire") usually terminates at two anchor posts placed on opposite sides of the sensor post to form a subsection of the intrusion detection system. Spiral shaped steel rods are sometimes placed vertically between the taut wires as to prevent the wires from bowing or sinking down, these elements are typically referred to as "slider posts". Each taut wire is maintained in tension between the anchor posts such that the sensor will detect a cut or deflection of the taut wire, triggering an alarm at a control center. Multiple subsections constructed in this manner are linked together to secure a given perimeter.

Taut wire systems are widely used to protect military bases, correctional facilities, airports and many other sites requiring a higher degree of protection than that of a purely physical barrier. Examples of taut wire systems employing tension sensors are found in U.S. Pat. Nos. 4,367,459, 4,829,286 and 4,500,873. The systems disclosed in the above mentioned patents, and many taut wire systems, suffer from a common flaw. The operation of the system is dependent on responding to changes in the tension of the taut wires. Therefore, it is possible to render such systems ineffective by manipulating the taut wires as to isolate a change in taut wire tension from the system's sensors. Such manipulation can be achieved by, for example, securing a frame device to the wire at two spaced apart points along the wire. If the wire is then cut at a point within the attached frame device, to allow the intruder to pass through the frame device, the sensor will not detect a change in tension, as the frame device will ensure that the wire tension is undisturbed outside the boundaries of the frame device. The same overriding effect can be achieved by securing the taut wires to the slider post. Other methods can be devised as to exploit this inherent weakness in tension sensing taut wire systems. The present invention seeks to eliminate this weakness.

The present invention also offers a cost effective method to increase the density of the taut wires in sensor based systems without incurring the expanse of purchasing additional sensors. Sensors for taut wire systems are usually made as to monitor a predetermined limited number of taut wires. The present invention overcomes this limitation as to allow for an additional taut wire to be connected to sensors with a limited number of existing taut wire connections.

SUMMARY OF THE INVENTION

One object of the invention is thus to provide an intrusion detection system that has the ability to detect an attempt to bypass its tension sensing elements. Another object is to provide a system and apparatus for inexpensively retrofitting existing taut wire fence systems with a secondary detection system for providing such ability.

There is thus provided, in accordance with the present invention, a taut wire fence section that comprises wire-supporting anchor posts to maintain the taut wires of the system in tension. A sensor post is provided between the two anchor posts, the sensor post including at least one tension sensor. The tension sensors of the preferred embodiment are connected to the taut wires extending between the two anchor posts such that the sensors detect changes in tension of the taut wires.

To protect against the bypassing of the tension sensors (such as by cutting the taut wires while using a frame device to maintain wire tension), one or more tensioned cable segments are provided in tension between the anchor posts (preferably along the lower portion of the fence) to form an electrical path, and an electrical monitoring device is used to monitor the continuity of the electrical path. These tensioned cable segments are preferably formed from a special cable that includes an outer layer which forms a physical barrier to cutting. Preferably, the electrical path includes two or more segments of cable that are electrically interconnected by a resistive member, and the monitoring device operates by effectively monitoring the resistance of the path. If one of the cable segments is cut, the monitoring device sets off an alarm.

The cable segments are also coupled to the tension sensors as ordinary taut wires. Thus, changes in the tensions of the cable segments will also be detected by the system.

The cable segments may be provided in-place of the lower-most taut wires of a conventional taut wire fence system, or may be provided in between existing taut wires to provide an alternating arrangement of taut wires and cable segments. In accordance with one aspect of the invention, the cable segments may be added to an existing taut wire fence system using a special sensor extender assembly. The sensor extender assembly attaches to an existing tension sensor that is designed to monitor a fixed number (e.g., 2) of taut wires, and allows the sensor to monitor a greater number of tensioned wires. In a preferred implementation, the sensor extender assembly allows a conventional two-wire tension sensor to monitor three wires (e.g., two ordinary taut wires plus a cable segment). In one embodiment, the sensor extender assembly provides a force transferring function from a remote point to the sensor's existing connection by using a rigid force-transferring member.

Using the sensor extender assemblies, an existing taut wire fence system can be retrofitted with the cable segments without adding additional sensors to the system, and without decreasing the density of barbed taut wires within the system. The sensor extender assemblies can also be used independently of the cable segments features, such as to increase the density of barbed taut wires within a system.

DESCRIPTION OF THE PREFERRED EMBODIMENT

Some of the past attempts to solve the weakness described above concentrated on improving the tension sensitivity of the systems. These solutions concentrated on the tension sensors and remedying the weakness at its core. Systems were configured such that the sensors will be able to detect a manipulation of the tension and cutting of the wires at a higher degree of sensitivity. One drawback of this approach is the large increase in cost of operation for such systems due to a very high false alarm rate. Another approach provided that the taut wires at the anchor posts be attached to the post not by a permanent fixture, which can be used to clamp a device to and isolate the taut wire from the sensor, but connected to another wire parallel to it as is shown in FIG. 1.

Figure 1:
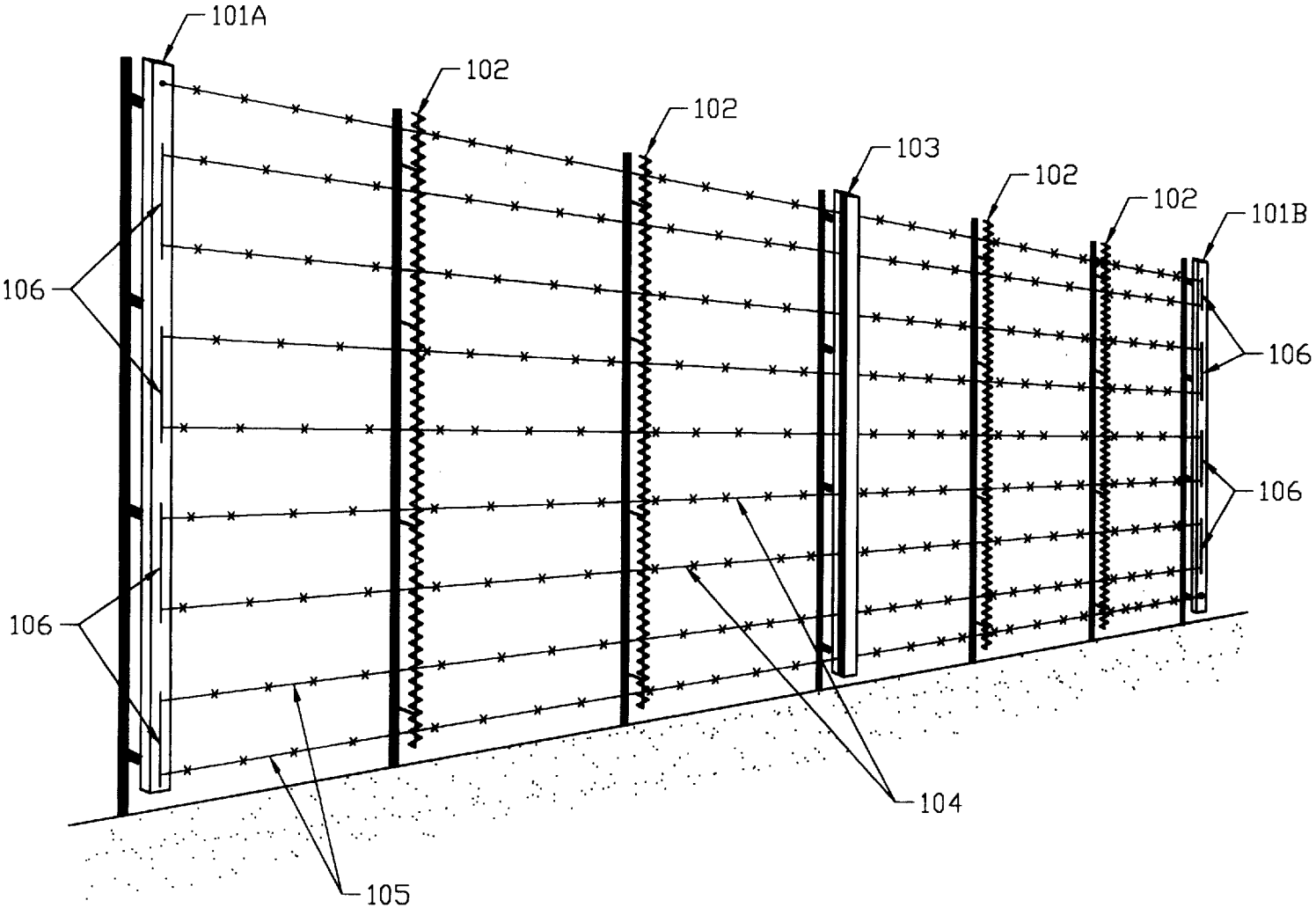
FIG. 1 illustrates one configuration of a typical taut wire intrusion detection system.

Referring now to FIG. 1, which illustrates one section of a prior art system, two anchor posts 101 are mounted at opposite ends of the section. A sensor post 103 is mounted at the center of the section between the two anchor posts 101. The sensor post is designed to contain the tension sensors 201 (FIG. 2) that are used to monitor the tensions of the taut wires 104. Such sensor posts and anchor posts are available from Safeguards Technology of Hackensack, N.J. Taut wires 104 are tensioned between the two anchor posts 101. The taut wires 104 are connected to tension sensors 201 (FIG. 2) in the sensor post 103. Slider posts 102, positioned between an anchor post 101 and the sensor post 103, are placed adjacent to the taut wires 104 to provide additional vertical support as to prevent a bowing of the taut wires 104. The slider posts 102 also serve as a mechanism to convert vertical force exerted on the taut wires into horizontal movement. The taut wires 104 are secured to the anchor post 101 by link rods 106. Adjacent taut wires 104 are joined together by link rods 106 that are positioned along the anchor posts 101. Referring to the bottom-most pair 105, for example, the lower taut wire 104 is attached to the bottom end of the lower most link rod 106 on the left-hand anchor post 101A, and the higher taut wire 104 of the pair 105 is attached to the upper end of the same link rod 106. At the opposite, right-hand, anchor post 101B, the higher taut wire 104 of the bottom-most wire pair 105 is paired with the taut wire 104 immediately above it by connecting these wires to the lower and upper portions of a link rod 106, respectively. In this manner, a series of such connections will form a zigzag configuration of taut wire 104 segments and link rods 106 from the bottom to the top of the section. The link rods 106 are not secured to the anchor post, but rather are held in place by the tension the pair of taut wires 105 exert on tabs (not shown) extending from the anchor posts 101. An attempt to cut a single taut wire 104 while maintaining the tension on its sensor post end will cause the link rod 106 to release from the tab and the adjoining taut wire will become slack. The change in tension of the adjoining taut wire 104 will be detected by the sensor attached to it.

Figure 2:
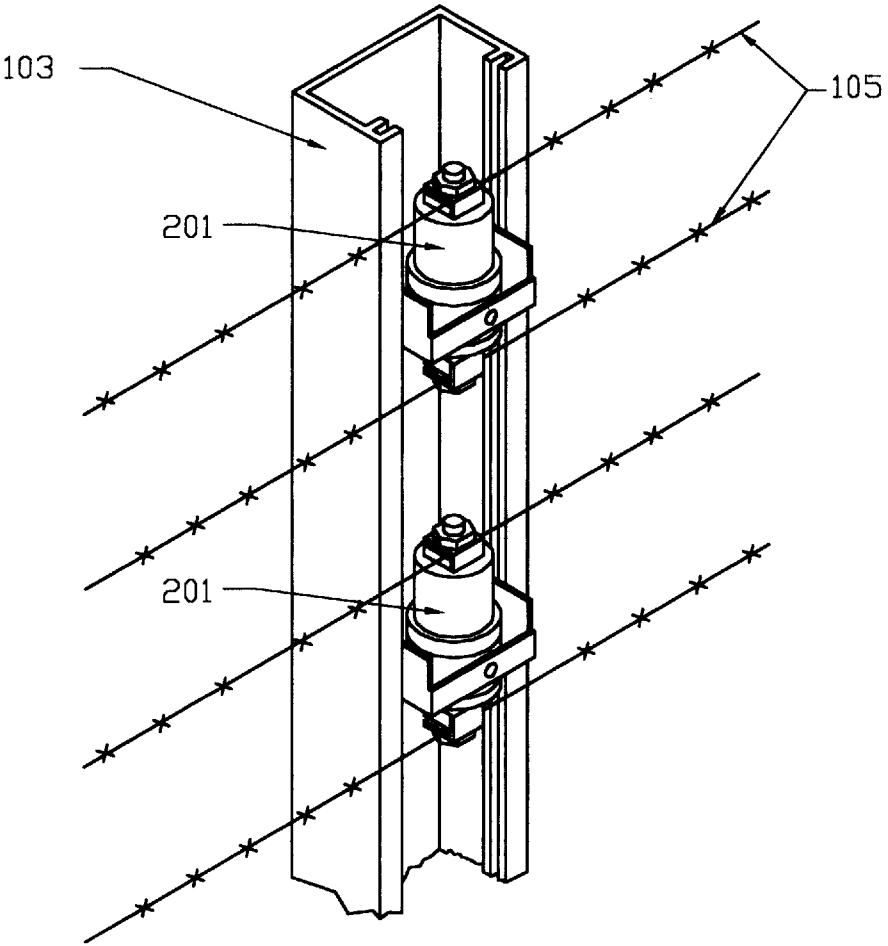
FIG. 2 is a cut-away perspective view that illustrates the details of the connection of the taut wires to a tension-sensing element of FIG. 1.

FIG. 2 illustrates the connection of the taut wires to the sensors 201 on the sensor post 103 in the prior art fence section of FIG. 1. The sensor post 103 presented is made of an extruded aluminum rigid channel. The sensors 201 are mounted inside the sensor post 103. Tensioned taut wires 105 are connected to the sensors 201. In the present example a pair of taut wires 105 is attached to each sensor 201 at its top and bottom by a bracket mounted on a metal bolt extending from the sensor 201. The sensors 201 presented are deflection sensors, detecting changes in tension by a deflection of the lower or upper portion of the sensor 201. A deflection of the sensor 201 exceeding a threshold level will cause the sensor 201 to generate an alarm signal. Sensors of this type are available from Safeguards Technology of Hackensack, N.J. Different numbers of taut wires 104 can be attached to each sensor 201 when other kinds of sensors 201 are used. For example, U.S. Pat. No. 4,367,459 (Amir) discloses a sensor that can be attached to more than two taut wires. The present solution (described below) is effective regardless of the number of taut wires attached to each sensor.

Figure 3:
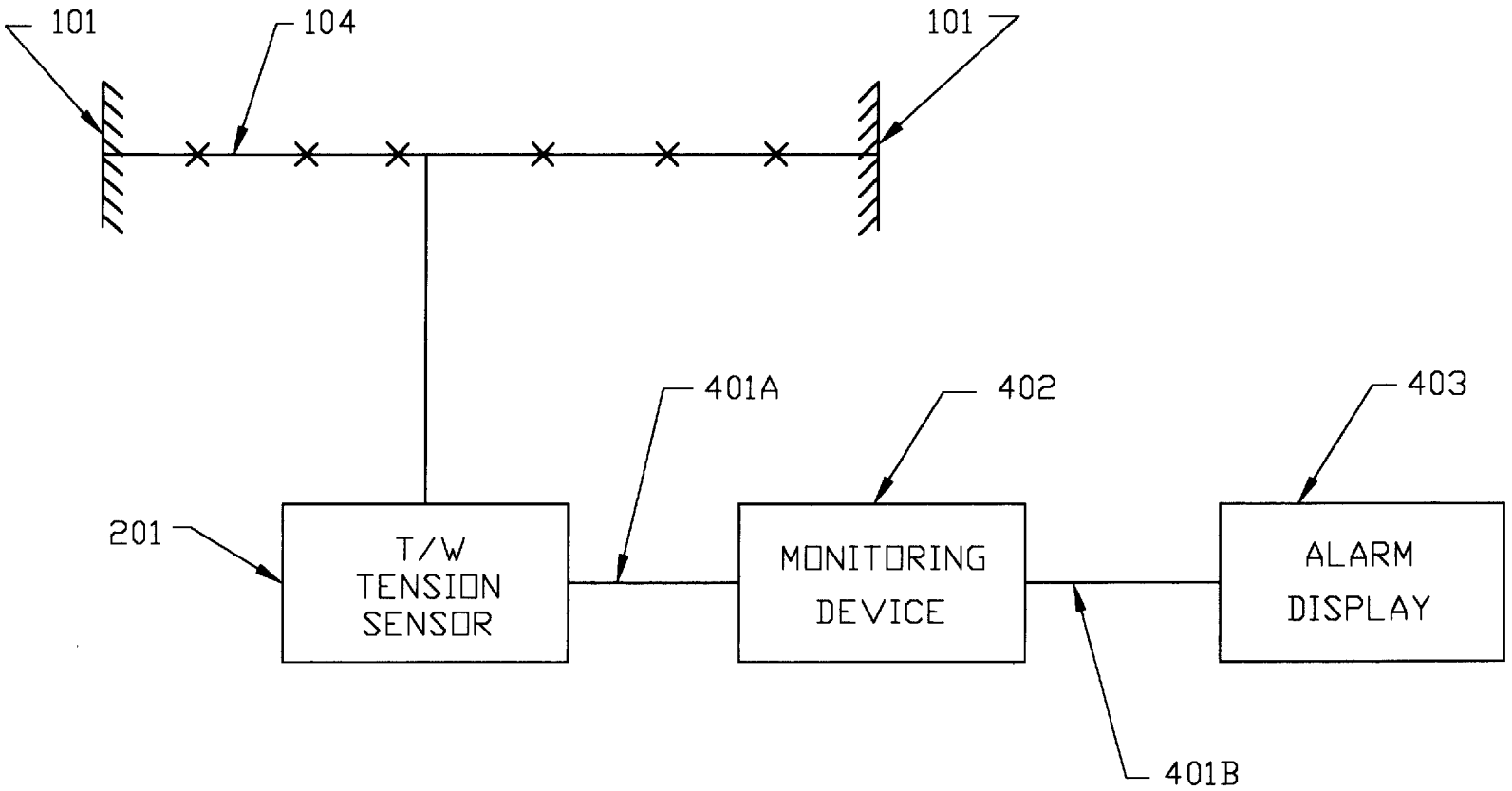
FIG. 3 is a block illustration of the components relating to a single wire in one configuration of a taut wire intrusion detection system as illustrated in FIG. 1.

FIG. 3 illustrates the logical interconnection of components within the section that is illustrated in FIG. 1. The taut wire 104 is tensioned between a pair of anchor posts 101. The tensioned taut wire 104 is connected at an intermediate point between the anchor posts 101 to a tension sensor 201. The tension sensor 201 is connected to a monitoring device 402 by a communication link 401A. All sensors 201 in a single sensor post 103 are preferably connected to the same monitoring device 402, such that the monitoring device 402 monitors multiple sensors concurrently. The monitoring device 402 is connected to an alarm display device 403 by a second communication link 401B. The alarm display device 403, which may be located at the main control building of the facility, is responsive to monitoring devices 402, displaying any alarm condition transmitted by a monitoring device 402. The communication links 401A, 401B may consist of any means commonly used to pass signals between two devices such as a simple electrical wire, a serial communication RS-232 cable or a wireless RF link. The monitoring device 402 is responsive to detection signals sent by the tension sensors 201. The monitoring device 402 is preferably implemented as a microprocessor driven printed circuit board that receives its power from the main control center via a below ground cable. The monitoring device 402 is preferably connected to each tension sensor 201 in the sensor post 102 such that the location of the tension sensor 201 in the sensor post 102 is known to the monitoring device 402. When a detection signal from a sensor 201 is received by the monitoring device 402, the monitoring device 402 sends an alarm signal to the alarm display device 403 together with information about the location (sensor post and individual sensor placement) of the alarm condition. The alarm display device 403 is used to display the location of any alarm condition.

An application of force to the taut wire 104 in an attempt to spread two or more wires apart will be detected by the tension sensor 201 attached to one of those taut wires 104. The tension sensor 201 will generate an alarm signal to the monitoring device 402 and the monitoring device 402 will then send an alarm message to the display device 403.

This configuration, using the link rods, suffers from the limitation of being able to detect the fixing of pressure at only one end of the cut taut wire. The use of a device equalizing tension on both ends of the wire will not be detected by the system since the tension at the sensors will remain the same.

U.S. Pat. No. 5,371,488 (Couch) describes another attempt to overcome the tension isolation problem. The Couch patent uses a resistance sensing device in conjunction with a device sensing variations in the longitudinal tension of the taut wire. The resistance of a conductive loop formed either by the taut wire or by the combination of the taut wire and another wire is monitored and a resistance signal is produced when it senses either a discontinuity or a variation in the resistance of the loop. The resistance of the conductive loop is monitored by an element within the sensor measuring the longitudinal tension of the wire. The system in the Couch patent does not include sensor posts. The sensors in the systems are suspended between two segments of taut wire.

The solution presented in the Couch patent suffers from several drawbacks. First, the core of the conductive loop is exposed to the outside and thereby easily bypassed. An intruder can easily access the current carrying element of the Couch system and "jump" two points along it to enable the cutting of the inside portion without any measurable variation in the resistance of the conductive loop. Second, since the conductive loop is not insulated, the portions of the loop in contact with the sensor and the anchor posts have to be mounted by an insulating element as to prevent grounding and other interference. By requiring such insulated mounting elements, both inside the sensor, where the taut wire attaches, and outside along the anchor post, the cost of a system can substantially increase. A Third problem arising from the use of a non insulated wire is the large number of false alarms caused by partially conductive material being blown into the fence such as a small piece of aluminum foil or mud. The Couch system will suffer from a possible shorting of the taut wires to a ground by accumulation of mud or dust on the exposed taut wire. The Couch patent also requires the conductive loop to go around the secured perimeter and cannot be used on a zone by zone basis.

Use of Electrically-Monitored Cable Segments

In accordance with one aspect of the invention, the tension isolation weakness described above is overcome by replacing one or more taut wires of each fence section with segments of a special cable, and by monitoring an electrical continuity of an inner core of the cable. The cable includes an outer layer that protects the inner portion of the cable from tampering. The strands of the outer layer are such that when tension is applied to the cable's ends the space between the strands decreases thereby increasing the shear strength of the cable. The outer layer also provides substantial longitudinal support for tension applied to the cable, allowing for a more brittle, sometimes more efficient or cheaper, conductive core. The cable used in the preferred embodiment also includes an inner insulating layer. The inner insulating layer eliminates the need to insulate the cable from the rest of the system thereby reducing the cost of the system. The use of an insulated conductor also reduces the false alarm rate of the system. An additional advantage of the present invention over past attempts is its versatility in fitting almost any sensor based system regardless of the inner structure of the sensors thereby eliminating the need for the monitoring element inside the sensor such as that used in the Couch patent.

Figure 5:
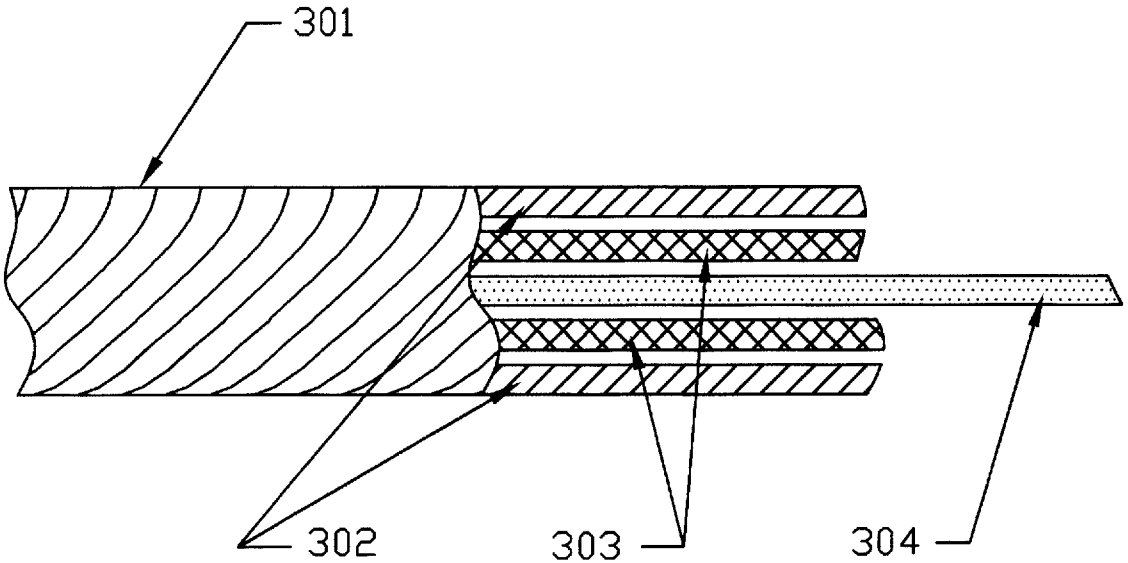
FIG. 5 illustrates the composition of a cable that can be used in one of the embodiments of the invention.

FIG. 5 illustrates a preferred embodiment of the cable. The cable 301 preferably has three layers. The outside layer 302 is made of a solid material, such as wound steel strands, that can be tensioned at levels required by the specific taut wire system. The strands of the outer layer 302 are preferably configured in a twisted spiral manner such that an application of tension to the cable prevents the spreading apart of the strands. The outside layer 302 is strong enough to impede the cutting of the cable 301 to get to its core 304. A steel strand outer layer 302 provides adequate deterrence to such cutting. The middle layer 303 is made of an electrically insulating material, such as a plastic or rubber of the type used with electrical cables and wires. The middle layer 303 prevents the outer layer from interfering with the current passed at the cable's core 304. The core 304 is composed of a conductive material such as copper, which preferably has a substantially constant electrical resistance per unit of length.

A cable of the type shown in FIG. 5 can be produced, for example, by applying steel strands in a twisted spiral pattern to the outer surface of an insulated electrical wire. This may be accomplished by using the electrical wire as a guidewire within a machine for producing wound wires.

Figure 4:
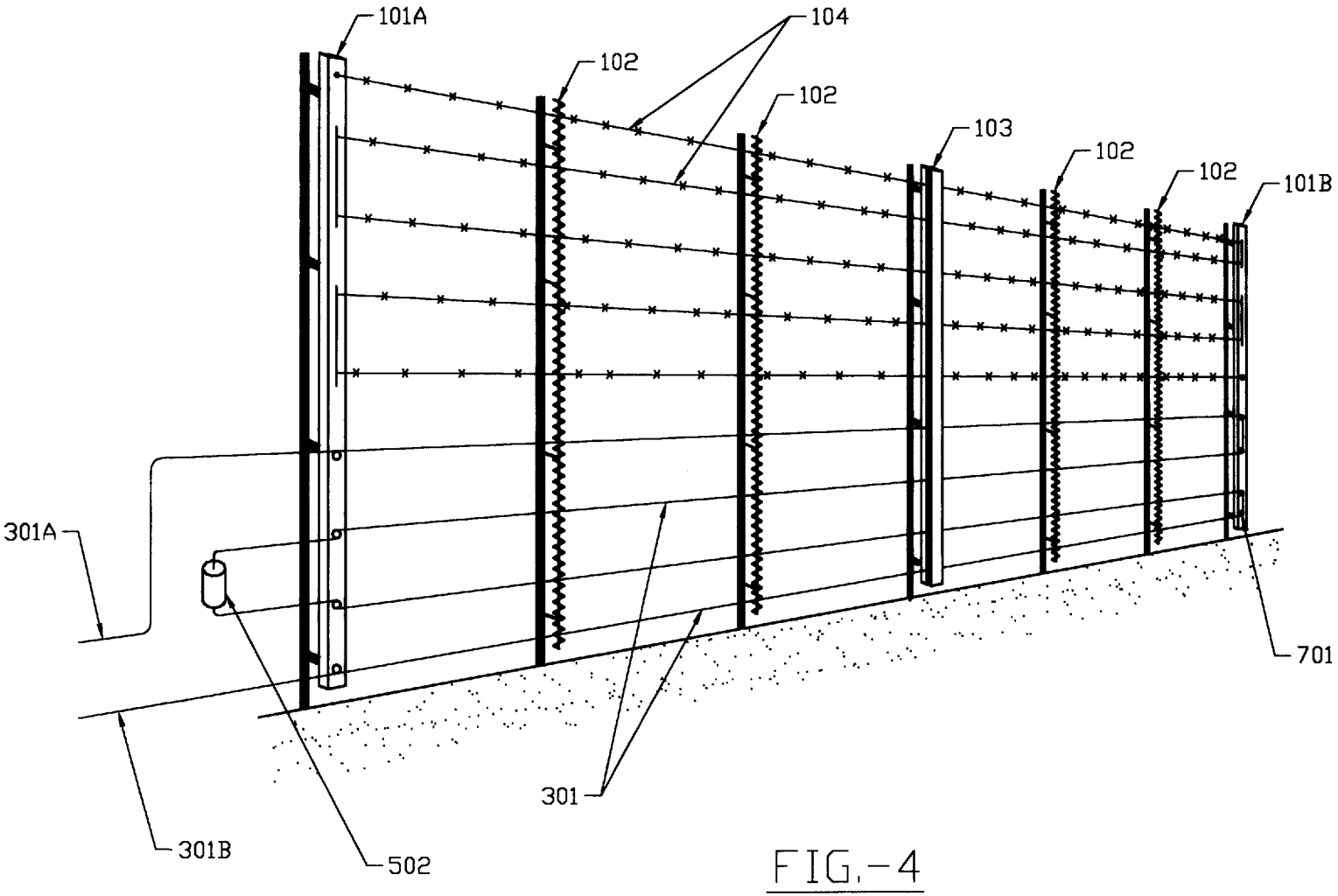
FIG. 4 illustrates one configuration of an embodiment of the present invention.

An embodiment of a section of a taut wire fence system according to the present invention is illustrated in FIG. 4. Two segments 301 of cable of the type depicted in FIG. 5 are provided in place of the lower-most taut wires of the FIG. 1 fence segment. As described below, a single cable segment may alternatively be used. Each cable segment 301 is attached to and tensioned between the two anchor posts 101A, 101B. Tension locks (FIG. 7) are used to maintain each cable segment 301 in tension. Link rods are not used to secure the cable segments 301 in this embodiment. As with the taut wires of the FIG. 1 system, the cable segments 301 are coupled to slider posts 102 to provide vertical support, and are coupled to a sensor post 103 that senses changes in the tension of the cable segments 301.

With further reference to FIG. 4, the inner cores 304 (FIG. 5) of the two cable segments 301 are electrically coupled together at one of the anchor posts 101A, to form a continuous electrical path between one end 301A of the upper cable segment 301 and a corresponding end 301B of the lower cable segment 301. As depicted in the drawing, the two cable segments 301 are preferably electrically coupled together at ends thereof using a resistor 502, so that the electrical path has a generally fixed, measurable resistance from one end 301A to the other end 301B. As described below, a circuit monitoring device 501 (FIG. 6) is used to monitor the resistance along this path, so that the system will detect changes in resistance caused, for example, by the cutting of a cable segment 301, or the detachment of a cable segment 301 from an anchor post 101. In the preferred embodiment, the resistor 502 is mounted within a secure enclosure (not shown) which protects the resistor 502 and the cable ends from tampering.

The use of one or more resistors to interconnect the cable segments 301 increases the reliability of the system, as it improved the system's ability to detect the "shorting out" of the cores of adjacent cable segments. It will be appreciated, however, that the invention can be practiced without using a resistive electrical path.

While the embodiment depicted in FIG. 4 uses two cable segments 301 interconnected by a single resistor, various other configurations may alternatively be used to provide the continuous electrical path. For example, more than two cable segments can be used (in place of the two segments 301), in which case additional resistors 502 may be used to electrically interconnect the cable segments 301. Alternatively, the resistor of FIG. 4 may be omitted, in which case a single cable segment may be used to provide the entire current carrying element. Also, a cable having a resistive inner core may be used to provide the desired resistance.

Figure 7:
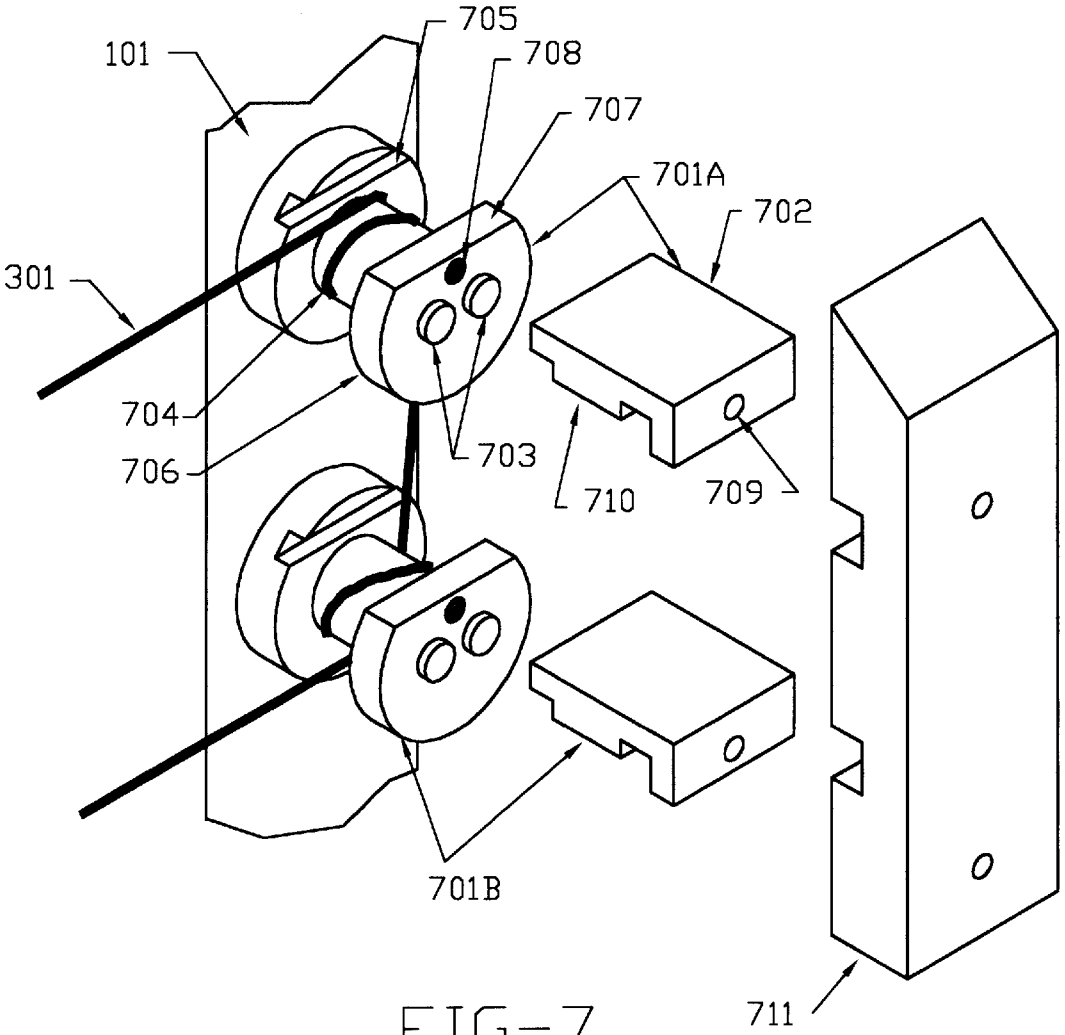
FIG. 7 illustrates a tensioning mechanism suitable for the configuration of FIG. 4.

FIG. 7 illustrates a tension locking mechanism that can be used to maintain the tension of the cable 301. The tension locking mechanism comprises two vertically aligned tension locks 701A, 701B and a cover 711. Each tension lock includes a base 706 and a locking cover 702. The base 706 is secured to an anchor post 101 using two pairs of bolts 703 and nuts (not shown). A channel 705 is included within the base 706 on the inside of its anchor post end. The opposite end is formed with a flat upper portion 707. The base 706 also includes an inner cylindrical member 704 between the two ends. The locking cover 702 includes a break portion 710 extending from its surface. The break portion 710 extends from the locking cover 702 such that the space between the break portion 710 and the inner cylindrical member 704 of the base 706 is less than the cable's 301 diameter, when the locking cover 702 is positioned on top of the base 706. The locking cover 702 is positioned on top of the base by sliding inside the channel 705 and resting on top of the flat edge 707. The locking cover is secured to the base by a screw (not shown) inserted through the openings 708, 709 in the base and the locking cover, respectively.

In operation, the cable 301 is first wound around the inner cylindrical member 704 of an upper tension lock 701A, entering from the direction of the opposite anchor post, as to form a taut wire segment, and exiting, after a complete revolution around the inner member 704, downward towards the second tension lock 701B. While tension is applied to the cable 301 the locking cover 702 is positioned on top of the base 706. While applying downward pressure on the locking cover 702 a screw is placed through openings 708, 709. The break portion 710 of the locking cover will hold the tension of the cable 301. The cable 301 is then wound around the inner cylindrical member 704 of the lower tension lock 701B entering downward and exiting, after a complete revolution around the inner cylindrical member 704, horizontally in the direction of the opposite anchor post as to form a taut wire segment. The locking cover 702 is then placed on top of the base 706 and secured in the manner described above to hold the tension of the cable 301. Once both tension locks are secured the cover 711 is positioned on top of the two tension locks and attached, using hooks (not shown), to the cable 301. The cover 711 in such a manner protects the non-tensioned portion of the cable 301 from tampering, and prevents the climbing on the anchor post by stepping on the tension locks 701A, 701B.

The tensioning mechanism on the anchor post 101 at the cable's 301 points of entry to the section includes only a single tension lock 701. Using a single tension lock 701, the cable is secured in the same manner it is secured to the individual tension locks 701A, 701B in FIG. 7. A modified cover (not shown) is used for the single tension lock units.

Figure 6:
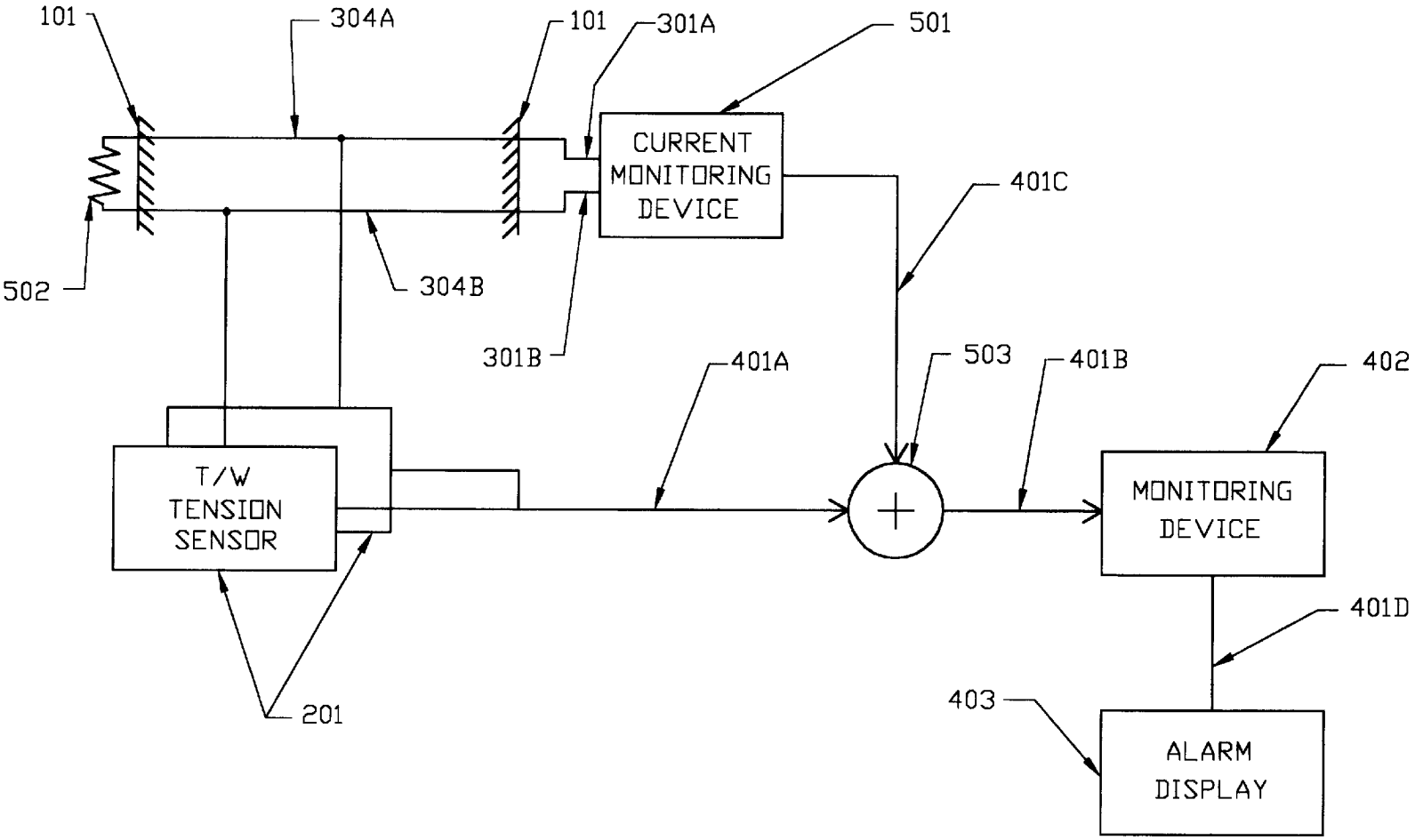
FIG. 6 is a block illustration of the components relating to a single tensioned cable in one embodiment of the present invention.

FIG. 6 illustrates the interconnection of electrical components within the modified fence section of the type shown in FIG. 4. As illustrated in the drawing, the resistor 502 interconnects the respective inner cores 304A 304B of the two cable segments 301 to provide a fixed electrical resistance between ends 301A and 301B. The two ends 301A and 301B are connected to a circuit monitoring device 501 that may, for example, be mounted within an sensor post 103 to provide protection against tampering. An output of the circuit monitoring device 501 is connected to a first input of a signal combiner 503 by a communication link 401C. Each cable segment 301 is connected, at a tensioned portion thereof, to a respective tension sensor 201 in the manner described above. The respective outputs of the tension sensors 201 are connected to a second signal input of the signal combiner 503 by a communication link 401A. The output of the signal combiner 503 is connected to the monitoring device 402 by a communication link 401B. The output of the monitoring device 402 is connected to an alarm display device 403 by a communication link 401D. The sensors 201, monitoring device 402, and alarm display device 403 are preferably of the same type as those used in the unmodified system as described above.

In operation, the circuit monitoring device 501 monitors the resistance of the electrical path and generates an alarm signal if a change in resistance, above a predetermined level, is detected. The signal combiner 503 passes out any signal it receives at its inputs. For example, an alarm signal from the sensors 201 will be sent to the monitoring device 402, regardless of the signal received from the circuit monitoring device 501. Also, an alarm from the circuit monitoring device 501 will be sent to the monitoring device 402, regardless of the signal received from the sensors 201.

The configurations in FIG. 4–7 provide a solution to the tension bypass problem described above. If an intruder secures the cable segments 301 to a constant tension device (to defeat the system's tension detection function), and then cuts or detaches one or more of the cable segments 301, the circuit monitoring device 501 will detect a change in resistance (caused by the interruption in the electrical path), and will output an alarm signal to the signal combiner 503. The circuit monitoring device 501 will also generate an alarm signal if the intruder obtains access to the respective cores 304 of the cable segments 301 and shorts the cores together, since shorting the cores 304 together will change the overall resistance of the electrical path. Any alarm signal generated by the circuit monitoring device 501 is passed by the signal combiner 503 to the monitoring device 402 and then to the alarm display device 403, which generates a visual alarm that indicates the location of the fence segment and the source of the alarm signal.

The system operates as the typical taut wire systems do in detecting tension variations. The tension sensors 201 attached to the cable segments 301 will detect an application of force to one or more of the cable segments 301 when, for example, an intruder spreads two cable segments 301 apart, or attempts to access the core 304 of a cable segment 301. Any tension sensor 201 that detects a sufficient change in tension will generate an alarm signal to the signal combiner 503 that is first passed to the monitoring device 402, and then to the alarm display device 403.

The wound steel strand outer layer 302 of the cable segments 301 provides a barrier that makes it difficult for an intruder to access the respective cores 304 of the segments in an attempt to defeat the circuit monitoring function of the system. Specifically, an intruder attempting to reach the core 304 of a cable segment 301 will have to either spread apart or cut the steel strands of the outer layer 302. When the cable 301 is tensioned, spreading the steel strands apart is very difficult since tension applied to the cable 301 at its ends has the effect of decreasing the space between the strands of the outer layer 302. The cable segment 301 will thus have to be pulled-in from the anchor post 101 to reduce its tension and allow access to the core 304, and such pulling will be detected by the tension sensors 201.

As indicated above, the system can alternatively be implemented without the use of resistive components, in which case the circuit monitoring device 501 may, for example, be configured to simply monitor the existence of a continuous electrical path between the ends of a single cable segment.

Use of Sensor Extenders to Add Wires to System

Another feature of the invention involves the use of a special sensor extender apparatus ("sensor extender") to monitor three or more wires (taut wires or cable segments) using a conventional two-wire sensor. As set forth below, this feature is preferably used within the system described above to overcome a potential weakness caused by the use of the cable segments. As will be apparent, however, the sensor extender feature can also be used in ordinary taut wire fence systems. For example, the sensor extenders can be used to increase the taut wire density of an existing fence (without the need to add sensors), or to reduce the number of sensors needed to achieve a desired wire density within a new fence.

By way of background, the use of unbarbed cable (FIG. 5) of the type described above, instead of barbed taut wires, can potentially reduce the effectiveness of the system as a physical barrier. For example, using a cable 301 instead of the barbed wires 104 can decrease the system's ability to prevent an intruder from sliding under the bottom-most wires. In the unmodified system, such an attempt to crawl under the fence would normally fail, since the barbs would catch the intruder's clothing and cause a change in the tension of the taut wire. One solution to this problem is to add barbs or barb-like members to the outer surface of the cable 301. This, however, significantly increases the cost and complexity of the cable segments.

The present invention overcomes this problem by using an alternating arrangement of barbed taut wires 104 and cable segments 301 within the lower portion of the fence. For example, the bottom-most wire segment can be a barbed taut wire, the next can be cable, the next another barbed taut wire, and so forth. In this manner, there will always be some barbed taut wires near a possible point of intrusion. Other alternating arrangements can be used, such as an arrangement having two barbed taut wires for every cable segment.

To provide such an alternating arrangement without significantly reducing the density of barbed taut wires, sensor extenders are used to extend the sensing capability of the conventional two-wire sensors. The use of sensor extenders advantageously enables an existing taut wire fence to be retrofitted with cable segments without the need to add additional sensors. In one implementation, the original density of barbed wires is maintained.

The sensor extender allows a sensor to monitor an additional taut wire (or cable segment) by providing a force transfer function from a point removed from the sensor's end, where an additional wire is attached, to the sensor's original wire connection, where a first wire is attached. A variety of different types and models of sensors can be extended using the sensor extender concept. The type of sensor used in the preferred embodiment is a two-wire sensor having terminals at opposite ends of the sensor. Each of the terminals is rigidly mounted within its own housing. The two housing portions are attached together such that they are able to move relative to each other. The two terminals are positioned such that there is no contact between them when the housing portions are attached together.

One of the terminals is mounted to its housing by means of a flowable material which permits repositioning of the terminal under conditions of low stress. Under conditions of high stress such as those caused by pulling a taut wire attached to one of the terminals the two terminals come together and close an electrical circuit thereby generating an alarm signal. The flowable material used in the sensors of the preferred embodiment is silicone putty. The sensor used in the preferred embodiment is disclosed in U.S. Pat. No. 4,683,356 (Stoler). Sensors of this type are usually referred to as "switching sensors" since the heart of the sensor is a switch like mechanism in its implementation as two electrical contacts either leaving open or closing an electrical circuit.

Sensors generally referred to as "strain sensors" may also be retrofitted using a sensor extender. Strain sensors use a semiconductor material as the central, strain sensitive, element of the sensor. One end of the strain element is rigidly mounted. The other end is usually connected to a taut wire terminal. The resistance of the strain element is continuously monitored. When stress is applied to the element its resistive properties change. The system generates an alarm signal for changes in resistance past a given threshold that are likely to be the result of an intrusion attempt. A sensor of this type employing a pair of strain sensing elements is disclosed in U.S. Pat. No. 4,829,287 (Kerr).

Figure 8:
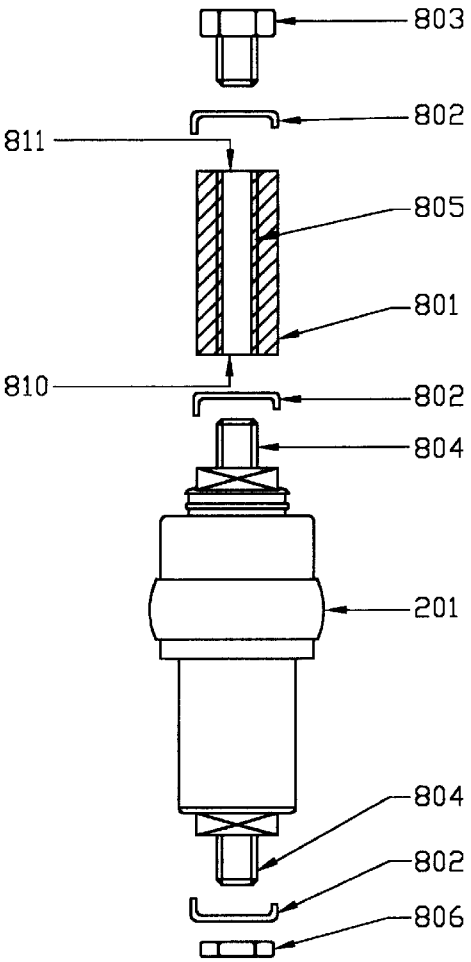
FIG. 8 is an exploded view in partial cross-section, which illustrates the components of the sensor extender apparatus for a two-wire sensor.

FIG. 8 illustrates the sensor extender configuration for use with a two-wire DTR 2000 series sensor manufactured by Magal Security, Ltd. of Yehud, Israel. The same configuration can also be used to add a second wire to the DTR 90 single-wire sensor manufactured by the same company. The sensor extender is a retrofit assembly which extends the sensing capability of existing sensors that have a fixed number of taut wire terminals. Referring now to FIG. 8, the sensor extender comprises an elongated tubular body 801 (shown in cross section) having a sensor end 810 and a remote end 811. The sensor extender body 801 is made of a rigid material such as steel or aluminum. The body 801 has flat outer surface portions (not shown) as to allow for its gripping by a wrench or a similar tool. The sensor extender apparatus also includes two washers 802 and a bolt 803. The two washers 802 are used as part of the mechanism securing the taut wires or cable segments to the sensor extender body 801 as to maintain pressure on the taut wires. The bolt 803 is used to fasten an additional taut wire or cable segment at the remote end 811 of the sensor extender body. The surface of the inner portion 805 of the sensor extender body 801 is threaded to allow the sensor extender body 801 to couple to the bolt 804 at its sensor end 810, and the additional bolt 803 on the remote end 811. A washer 802, nut 806 and bolt 804 on the sensor are provided to attach the lower taut wire or cable segment to the sensor as is done in the unmodified system.

Figure 9:
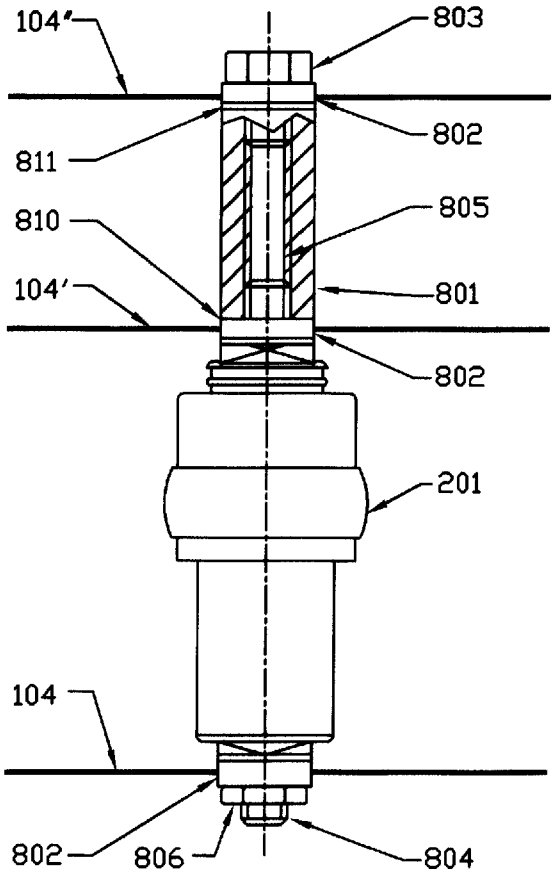
FIG. 9 illustrates the use of a conventional two wire sensor plus a sensor extender assembly to monitor three tensioned wires (cables or taut wires).

FIG. 9 illustrates how a conventional two-wire sensor combined with a sensor extender may be used to monitor three wires 104, 104', 104", each of which can be either a taut wire or a cable. The sensor extender provides a force transferring function from the remote end 811 to the sensor end 810 without inhibiting the sensor's ability to monitor the middle wire 104'. The sensor extender body 801 is used to secure the middle wire 104' at its sensor end 810. The sensor extender body 801 is coupled to the sensor 201 as to apply pressure to a washer 802, thereby securing the middle wire 104'. The additional wire 104" is attached to the remote end 811 of the sensor extender by using a washer 802 and a bolt 803. A third taut wire 104 is attached at the lower portion of the sensor 201.

The use of the sensor extender provides for the monitoring of an additional wire while maintaining the tension change sensitivity of the unmodified system. For example, referring to FIG. 9, when pressure is exerted on the middle wire 104', the top portion of the sensor 201 will move in the direction of pressure change. The additional wire 104" will move along with the sensor end taut wire 104'. The sensor 201 will therefore bend, in the same manner it did prior to the installation of the sensor extender, generating an alarm signal. The same alarm signal will be generated for a corresponding movement of the additional wire 104" at the remote end 811 of the sensor extender.

From the description above it can be appreciated that the sensor extender can also be incorporated into a system to merely provide for an increased barbed taut wire density without incurring the additional expenses of purchasing sensors. The addition of such taut wires will increase the sensitivity and overall impregnability of the existing system. The sensor extender will also allow a user to upgrade its system after the system has been operational for some time.

Modifications of the sensor extender configuration of FIG. 8 can be utilized to achieve the same extending effect on various types of sensors. The sensor extender can be adapted to other types of sensors that are configured to monitor a limited number of taut wires. For example, a sensor that is mounted such that it lies on a plane perpendicular to that of the one formed by the taut wires will require a modified extender body that has its end connections on its sides, as opposed to its top and bottom as in the extender body of FIG. 8.

The descriptions and illustrations provided are only examples of the possible embodiments the invention. Other variations, modifications and applications of the invention will be apparent to those skilled in the art.

What is claimed is:

1. An intrusion barrier and detection system comprising:

first and second anchor posts spaced apart from one another to define a section of an intrusion detection fence;

at least one barbed wire extending under tension between the first and second anchor posts;

an electrically-conductive path extending between first and second ends of the path, the electrically-conductive path comprising at least one cable segment which extends under tension between the first and second anchor posts, the cable segment forming a portion of the fence, said cable segment comprises:

an inner, conductive core which forms a portion of the electrically-conductive path;

a protective layer formed over the inner core, the protective layer providing a barrier against the cutting of the cable;

a tension sensor coupled to the cable segment between the first and second anchor posts, the tension sensor configured to detect changes in the tension of the cable; and a circuit monitoring device coupled to the first and second ends of the electrically-conductive path, the circuit monitoring device configured to monitor the resistance of the electrically-conductive path to detect at least a cutting of the cable.

2. The intrusion barrier and detection system of claim 1, wherein the electrically conductive path comprises first and second cable segments that are electrically coupled together by an electrically resistive member.

3. The intrusion barrier and detection system of claim 1, wherein the cable segment further comprises an intermediate insulating layer formed over the conductive core.

4. The intrusion barrier and detection system of claim 1, wherein the protective layer comprises wound steel strands.

5. The intrusion barrier and detection system of claim 1, wherein the tension sensor is a two-wire sensor having a sensor extender assembly coupled thereto, the sensor extender assembly allowing at least three tensioned wire segments to be monitored concurrently with the two-wire sensor.

6. The intrusion barrier and detection system of claim 1, wherein the tension sensor is configured to attach to and monitor a fixed number of wire segments, and is coupled to a sensor extender assembly which allows the tension sensor to monitor more than the fixed number of wire segments.

7. The intrusion barrier and detection system of claim 6, wherein the sensor extender assembly comprises an elongated member having first and second ends, the first end attached to an end of the tension sensor, the second end coupled to a tensioned wire segment.

8. The intrusion barrier and detection system of claim 1, further comprising a sensor post positioned between the first and second anchor posts, the sensor post housing the tension sensor.

9. A method of extending a number of monitored, tensioned wire segments within a section of a taut wire fence without the need to add additional sensors to the fence, the taut wire fence comprising first and second anchor posts having a plurality of tensioned taut wire segments extending therebetween, and comprising at least one tension sensor which is coupled to and adapted to monitor a fixed number of tensioned wire segments, the method comprising the steps of:

attaching a sensor extender assembly to the tension sensor, the sensor extender assembly adapted to retrofit the tension sensor to allow the tension sensor to monitor more than the fixed number of tensioned wire segments;

extending an additional wire segment between the first and second anchor posts such that the additional wire segment is maintained in tension; and attaching the additional wire segment to the sensor extender assembly.

10. The method as in claim 9, wherein the additional wire segment comprises a segment of cable having an inner, conductive core surrounded by a physical barrier layer, and wherein the method further comprises passing a current through the inner core to monitor for at least a cutting of the cable segment.

11. The method as in claim 9, wherein the sensor extender assembly comprises an elongated force transfer member, and the step of attaching comprises attaching a first end of the force transfer member to the tension sensor and attaching a second end of the force transfer member to the additional wire segment.

12. An apparatus allowing the monitoring of an additional wire segment by a tension sensor pre-configured to monitor a fixed number of generally parallel wire segments, comprising:

an elongated rigid member having a first end and a second end;

the first end including means to couple to the tension sensor;

the second end including means to couple to the additional wire segment;

the apparatus thereby extending the monitoring capability of the tension sensor.

13. The apparatus according to claim 12, wherein the elongated rigid member is tubular.

14. The apparatus according to claim 12, wherein the elongated member has a polygonal outer configuration, and has threads along an inner wall to receive at least one bolt.

* * * * *